US009343012B2

(12) United States Patent
Wen et al.

(10) Patent No.: US 9,343,012 B2
(45) Date of Patent: May 17, 2016

(54) DRIVING CIRCUIT OF AMOLED AND METHOD FOR DRIVING THE AMOLED

(71) Applicant: SHENZHEN CHINA STAR OPTOELECTRONICS TECHNOLOGY CO., LTD, Shenzhen (CN)

(72) Inventors: Yi-chien Wen, Shenzhen (CN); Li-wei Chu, Shenzhen (CN)

( * ) Notice: Subject to any disclaimer, the term of this patent is extended or adjusted under 35 U.S.C. 154(b) by 109 days.

(21) Appl. No.: 14/241,080

(22) PCT Filed: Jan. 23, 2014

(86) PCT No.: PCT/CN2014/071190

§ 371 (c)(1),
(2) Date: Feb. 26, 2014

(87) PCT Pub. No.: WO2015/100824

PCT Pub. Date: Jul. 9, 2015

(65) Prior Publication Data

US 2015/0187255 A1 Jul. 2, 2015

(30) Foreign Application Priority Data

Dec. 31, 2013 (CN) ..... 2013 1 0753793
Jan. 13, 2014 (CN) ..... 2014 1 0014397

(51) Int. Cl.
*G09G 3/32* (2016.01)
*G09G 3/20* (2006.01)

(52) U.S. Cl.
CPC ..... *G09G 3/3233* (2013.01); *G09G 3/2025* (2013.01); *G09G 2300/0866* (2013.01); *G09G 2320/0266* (2013.01)

(58) Field of Classification Search
CPC . G09G 3/3233; G09G 3/3258; G09G 3/2022; G09G 3/3208; G09G 3/3325; G09G 3/3291; G09G 3/2025; G09G 2300/0866; G09G 2320/0266
See application file for complete search history.

(56) References Cited

U.S. PATENT DOCUMENTS 5,748,160 A * 5/1998 Shieh ..... G09G 3/2011 345/210
6,714,268 B2 * 3/2004 Wang ..... G09G 3/20 257/40

(Continued)

FOREIGN PATENT DOCUMENTS

CN 1722921 A 1/2006
CN 101647051 A 2/2010

(Continued)

OTHER PUBLICATIONS

Ge Ying Jie, the International Searching Authority written comments, Sep. 2014, CN.

*Primary Examiner* — Lun-Yi Lao
*Assistant Examiner* — Peter D McLoone

(57) ABSTRACT

A driving circuit of an active matrix/organic light emitting diode (AMOLED) includes a first semiconductor controllable switch, a second semiconductor controllable switch, an energy-storage capacitor, an organic light emitting diode, and a sequential control unit that divides a driving time of one frame of the organic light emitting diode into driving times of N subframes. An output end of the second semiconductor controllable switch is coupled to an anode of the organic light emitting diode, a source electrode of the first semiconductor controllable switch receives a data driving signal of the AMOLED, a gate electrode of the first semiconductor controllable switch receives a scan driving signal of the AMOLED, a drain electrode of the AMOLED is connected with a gate electrode of the second semiconductor controllable switch, and the energy-storage capacitor is connected in series between a source electrode and the gate electrode of the second semiconductor controllable switch. The data driving signal is divided into an active signal that drives display of the organic light emitting diode and a blanking signal that turns off display of the organic light emitting diode in the driving time of each of the subframes.

3 Claims, 3 Drawing Sheets

(56) References Cited

U.S. PATENT DOCUMENTS

| | | | | |
|---|---|---|---|---|
| 7,999,768 | B2 * | 8/2011 | Kim | G09G 3/3233 345/76 |
| 8,810,488 | B2 * | 8/2014 | Senda | G09G 3/3225 345/206 |
| 2003/0193457 | A1 * | 10/2003 | Wang et al. | 345/84 |
| 2008/0001974 | A1 * | 1/2008 | Kim | G09G 3/3233 345/690 |
| 2009/0096736 | A1 * | 4/2009 | Nam | G09G 3/3648 345/94 |
| 2009/0195483 | A1 * | 8/2009 | Naugler, Jr. | G09G 3/3233 345/76 |
| 2010/0053223 | A1 * | 3/2010 | Otsuka | G09G 3/2022 345/690 |
| 2010/0103182 | A1 * | 4/2010 | Kawabe | G09G 3/2022 345/545 |
| 2012/0120046 | A1 * | 5/2012 | Senda | G09G 3/3225 345/211 |
| 2012/0229528 | A1 * | 9/2012 | Langendijk | G09G 3/2025 345/690 |
| 2012/0313903 | A1 | 12/2012 | Pyon et al. | |
| 2013/0321364 | A1 | 12/2013 | Chong et al. | |
| 2014/0035974 | A1 * | 2/2014 | Jinta | G09G 3/02 345/698 |
| 2014/0085284 | A1 * | 3/2014 | Sun et al. | 345/211 |
| 2014/0320471 | A1 * | 10/2014 | Li | 345/82 |
| 2014/0361708 | A1 * | 12/2014 | Nathan | G09G 3/3233 315/291 |

FOREIGN PATENT DOCUMENTS

| | | | |
|---|---|---|---|
| CN | 101661705 | A | 3/2010 |
| CN | 102473377 | A | 5/2012 |
| CN | 102930815 | A | 2/2013 |
| CN | 103198797 | A | 7/2013 |
| CN | 203179478 | U | 9/2013 |

* cited by examiner

--Prior Art--

DRIVING CIRCUIT OF AMOLED AND METHOD FOR DRIVING THE AMOLED

TECHNICAL FIELD

The present disclosure relates to electronic display, and more particularly to a driving circuit of an active matrix/organic light emitting diode (AMOLED) and a method for driving the AMOLED.

BACKGROUND

As manufacturing and materials for a flat panel display improves, active matrix/organic light emitting diodes (AMOLED) are becoming more important for use in displays. FIG. 1 shows a driving circuit of the AMOLED that comprises a first semiconductor controllable switch T1, a second semiconductor controllable switch T2, an energy-storage capacitor C1, and an organic light emitting diode D1. A first end of the second semiconductor controllable switch T2 receives a first control voltage VDD and a second end of the second semiconductor controllable switch T2 is connected with an anode of the organic light emitting diode D1. A cathode of the organic light emitting diode D1 receives a second control voltage VSS. A source electrode of the first semiconductor controllable switch T1 receives a data driving signal of the AMOLED, a gate electrode of the first semiconductor controllable switch T1 receives a scan driving signal of the AMOLED, and a drain electrode of the first semiconductor controllable switch T1 is connected with a gate electrode of the second semiconductor controllable switch T2. The energy-storage capacitor is connected in series between a source electrode and the gate electrode of the second semiconductor controllable switch T2, thus, the second semiconductor controllable switch T2 works in a saturation region, which provides current to the AMOLED and makes the AMOLED light.

Brightness of the driving circuit of a typical AMOLED weakens, which affects uniformity of a display region.

SUMMARY

In view of the above-described problems, the aim of the present disclosure is to provide a driving circuit of an active matrix/organic light emitting diode (AMOLED) and a driving method of the AMOLED capable of improving uniformity of the display of the AMOLED.

The aim of the present disclosure is achieved by the following technical methods.

A driving circuit of the AMOLED comprises a first semiconductor controllable switch, a second semiconductor controllable switch, an energy-storage capacitor, an organic light emitting diode, and a sequential control unit that divides a driving time of one frame of the organic light emitting diode into driving times of N subframes. An output end of the second semiconductor controllable switch is coupled to an anode of the organic light emitting diode, a source electrode of the first semiconductor controllable switch receives a data driving signal of the AMOLED, a gate electrode of the first semiconductor controllable switch receives a scan driving signal of the AMOLED, a drain electrode of the AMOLED is connected with a gate electrode of the second semiconductor controllable switch, and the energy-storage capacitor is connected in series between a source electrode and the gate electrode of the second semiconductor controllable switch.

The data driving signal is divided into an active signal that drives display of the organic light emitting diode and a blanking signal that turns off display of the organic light emitting diode in the driving time of each of the subframes.

Furthermore, the driving circuit comprises a third semiconductor controllable switch, the third semiconductor controllable switch is connected in series with the gate electrode of the second semiconductor controllable switch, and a low level signal is input to the third semiconductor controllable switch.

The third semiconductor controllable switch is used and the energy-storage capacitor discharges in the driving time of one frame of the organic light emitting diode, thereby effectively avoiding the electric charge of the energy-storage capacitor affecting the deflection voltage of the first semiconductor controllable switch, and improves uniformity of the display of the AMOLED.

Furthermore, the driving circuit comprises an over-voltage driving unit that increases current of the organic light emitting diode when the organic light emitting diode displays, where the over-voltage driving unit comprises a data driving unit that provides the data driving signal and a gamma correction unit coupled to the data driving unit. In a time of outputting one or more blanking signals, the over-voltage driving unit increases current of the organic light emitting diode through increasing a voltage of an output end of the second semiconductor controllable switch, for reducing a voltage of the cathode of the organic light emitting diode, and increasing an output voltage of the gamma correction unit.

The present disclosure use a pulse-width modulation PWM to drive the AMOLED, and the driving time of one frame of the organic light emitting diode D1 is divided into driving times of N subframes to obtain effect of the different gray scales. Thus, in the driving time of the subframe, if the time of outputting the active signal short, the time outputting the blanking signal is correspondingly long, which causes greater brightness loss. Therefore, when driving the subsequent subframes, transmission speed of the data driving signal needs to be correspondingly increased to compensate for brightness loss. However, the transmission speed of the data driving signal is limited by transmission speed of interface of the driving circuit, and as resolution of the display panel increases, limitation of the transmission speed of the data driving signal correspondingly increases. The present disclosure increases the driving voltage of the organic light emitting diode in the time of outputting the blanking signal, thus, in a time of outputting a next active signal, the current of the organic light emitting diode correspondingly increases because of increased driving voltage. The driving voltage stops increasing after the time of outputting the blanking signal, which does not occupy display time of the organic light emitting diode. Even if the transmission speed of interface of the driving circuit limits the transmission speed of the data driving signal, the driving voltage also can be increased in the time of outputting the blanking signal. In addition, in the time of outputting the blanking signal, the organic light emitting diode does not display, and change of the voltage cannot cause a display image to flicker.

Furthermore, the over-voltage driving unit comprises a first multiplexer, a second multiplexer, and a third multiplexer, where an input end of the first multiplexer receives X reference voltages that are different, an output end of the first multiplexer is coupled to an input end of the second semiconductor controllable switch, and the sequential control unit is coupled to a control end of the first multiplexer.

In the driving time from a first subframe to a (N−X)th subframe, a time of outputting the active signal of the driving time of each of the subframes successively increases. From the driving time of a (N−X+1)th subframe on, the first multiplexer outputs one reference voltage, and the reference voltage successively increases in the time of outputting the blanking signal of the driving time of each of the subframes. The time of outputting the active signal of the driving time of the each of the subframes is equal to the time of outputting the active signal of the driving time of a (N−X)th subframe.

An input end of the second multiplexer receives Y reference voltages that are different, an output end of the first multiplexer is coupled to a cathode of the organic light emitting diode, and the sequential control unit is coupled to a control end of the second multiplexer. From the driving time of a (N−Y)th subframe on, the second multiplexer outputs one reference voltage in the time of outputting the blanking signal of the driving time of each of the subframes, and the reference voltage successively reduces.

An input end of the third multiplexer receives Z reference voltages that are different, an output end of the third multiplexer is coupled to the gamma correction unit, and the sequential control unit is coupled to a control end of the third multiplexer. From the driving time of a (N−Z)th subframe on, the third multiplexer outputs one reference voltage in the time of outputting the blanking signal of the driving tune of each of the subframes, and the reference voltage successively increases. X, Y, and Z are natural numbers, and are less than N.

The voltage of the anode of the organic light emitting diode increases and the voltage of the cathode of the organic light emitting diode decreases, which directly increase voltage difference between the anode and the cathode of the organic light emitting diode to increase the current of the organic light emitting diode D1 and improve the brightness of the organic light emitting diode. The organic light emitting diode is connected in series with the semiconductor controllable switch, where the semiconductor controllable switch work in the saturation region, and the data driving signal is coupled to the gate electrode of the semiconductor controllable switch. Thus, a voltage of the data driving signal increases and the current of the organic light emitting diode correspondingly increases, which increases the brightness of the organic light emitting diode.

A method for driving an AMOLED, comprising: dividing a driving time of one frame of an organic light emitting diode into driving times of N subframes, and dividing a data driving signal into an active signal that drives display of the organic light emitting diode and a blanking signal that turns off display of the organic light emitting diode in the driving time of each of the subframes. N is a natural number, and is greater than or equal to 2.

Furthermore, an energy-storage capacitor that corresponds to the organic light emitting diode discharges in a time of outputting any one or more blanking signals.

The present disclosure also may discharge the energy-storage capacitor in the driving time of one frame of the organic light emitting diode, and thereby effectively avoiding the deflection voltage of the first semiconductor controllable switch from being influenced by the electric charge of the energy-storage capacitor affecting, and improves uniformity of the display of the AMOLED.

Furthermore, the driving time of each of the subframes is same. In the driving time of one frame of the organic light emitting diode, the time of outputting the active signal of the driving time of each of the subframes successively increases.

In the time of outputting any one or more blanking signals, current of the organic light emitting diode increases through increasing a voltage of the data driving signal, reducing a voltage of the cathode of the organic light emitting diode, and increasing a voltage of an anode of the organic light emitting diode.

The present disclosure uses the pulse-width modulation PWM to drive the AMOLED, and the driving time of one frame of the organic light emitting diode D1 is divided into driving times of N subframes to obtain effect of the different gray scales. Thus, in the driving time of the subframe, if the time of outputting the active signal is short, the time of outputting the blanking signal is correspondingly long, which causes greater brightness loss. Therefore, when driving the subsequent subframes, transmission speed of the data driving signal needs to correspondingly increase to compensate brightness loss. However, the transmission speed of the data driving signal is limited by transmission speed of interface of the driving circuit, and as resolution of the display panel increases, limitation of the transmission speed of the data driving signal correspondingly increases. The present disclosure increases the driving voltage of the organic light emitting diode in the time of outputting the blanking signal, and in the time of outputting a next active signal, the current of the organic light emitting diode correspondingly increases because of increased driving voltage. The driving voltage stops increasing after the tune of outputting the blanking signal, which does not occupy display time of the organic light emitting diode. Even if the transmission speed of interface of the driving circuit limits the transmission speed of the data driving signal, the driving voltage also can be increased in the time of outputting the blanking signal. In addition, in the time of outputting the blanking signal, the organic light emitting diode does not display, and change of the voltage cannot cause the display image to flicker.

Furthermore, the voltage input to the anode of the organic light emitting diode is divided into X levels reference voltage; from the driving time of a (N−X+1)th subframe on, one reference voltage is input to the anode of the organic light emitting diode in the time of outputting the blanking signal of the driving time of each of the subframes, and the reference voltage successively increases. X is a natural number, and is less than N The voltage of the anode of the organic light emitting diode increases and the voltage of the cathode of the organic light emitting diode decreases, which directly increase voltage difference between the anode and the cathode of the organic light emitting diode to increase the current of the organic light emitting diode and improve the brightness of the organic light emitting diode.

Furthermore, the voltage input to the cathode of the organic light emitting diode is divided into Y levels reference voltage. From the driving time of a (N−Y)th subframes on, one reference voltage is input to the cathode of the organic light emitting diode in the time of outputting the blanking signal of the driving time each of the subframes and the reference voltage successively reduces. Y is a natural number, and is less than N.

Furthermore, an increment voltage of the data driving signal of the organic light emitting diode is divided into Z levels increment voltage; from the driving time of a (N−Z)th subframe on, one increment voltage is output in the time of outputting the blanking signal of the driving time of each of the subframes, and the increment voltage successively increases. Z is a natural number, and is less than N.

The organic light emitting diode is connected in series with the semiconductor controllable switch, where the semiconductor controllable switch works in the saturation region, and the data driving signal is coupled to the gate electrode of the semiconductor controllable switch. Thus, a voltage of the data driving signal increases and the current of the organic light emitting diode correspondingly increases, which increases the brightness of the organic light emitting diode.

The driving circuit of the AMOLED provides current to the organic light emitting diode, through charge of the energy-storage capacitor and makes the organic light emitting diode light. However, the semiconductor controllable switch connected with the organic light emitting diode in series is influenced by long periods of the electric charge of the energy-storage capacitor, furthermore, a bias voltage between the gate electrode and the source electrode of the semiconductor controllable switch is influenced, thus, the current flowing the organic light emitting diode D1 changes, which affects uniformity of the display. The present disclosure divides the driving time of the frame of the organic light emitting diode into the driving times of N subframes. The data driving signal is divided into the active signal that drives display of the organic light emitting diode and the blanking signal that turns of display of the organic light emitting diode in the driving time of each of the subframes. The first semiconductor controllable switch turns off and the energy-storage capacitor starts to discharge instead of charging in the time of outputting the blanking signal, which avoids the second semiconductor controllable switch from being continually affected by current the electric charge of the energy-storage capacitor, thereby improving uniformity of the display of the AMOLED.

DETAILED DESCRIPTION

Figure 1:
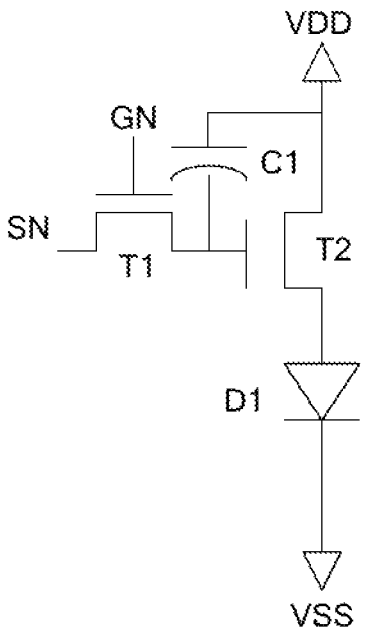
FIG. 1 is a schematic diagram of a driving circuit of a typical active matrix/organic light emitting diode (AMOLED).
Figure 2:
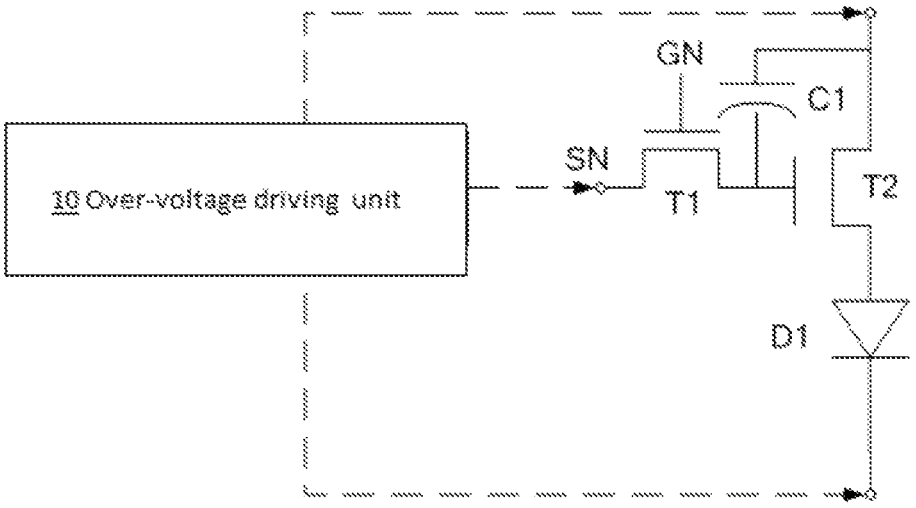
FIG. 2 is a schematic diagram of a driving circuit of an AMOLED of the present disclosure.

As shown in FIG. 2, the present disclosure provides a driving circuit of an active matrix/organic light emitting diode (AMOLED) where the driving circuit comprises a first semiconductor controllable switch T1, a second semiconductor controllable switch T2, an energy-storage capacitor C1, and an organic light emitting diode D1. An output end of the second semiconductor controllable switch T2 is coupled to an anode of the organic light emitting diode D1, a source electrode of the first semiconductor controllable switch T1 receives a data driving signal SN of the AMOLED, a gate electrode of the first semiconductor controllable switch T1 receives a scan driving signal GN of the AMOLED, a drain electrode of the first semiconductor controllable switch T1 is connected with a gate electrode of the second semiconductor controllable switch T2, and the energy-storage capacitor C1 is connected in series between a source electrode and the gate electrode of the second semiconductor controllable switch T2.

The driving circuit of the AMOLED comprises a sequential control unit that divides a driving time of one frame of the organic light emitting diode D1 into driving times of N subframes. The data driving signal is divided into an active signal that drives display of the organic light emitting diode D1 and a blanking signal that turns off display of the organic light emitting diode D1 in the driving time of each of the subframes. The driving time of one subframe comprises a time of outputting the active signal and a time of outputting the blanking signal.

The driving circuit of the AMOLED provides current to the organic light emitting diode D1 through charge of the energy-storage capacitor C1 and makes the organic light emitting diode D1 light. However, the semiconductor controllable switch connected with the organic light emitting diode D1 in series is influenced by long periods of electric charge of the energy-storage capacitor C1, furthermore, a bias voltage between the gate electrode and the source electrode of the semiconductor controllable switch is influenced, thus, the current flowing the organic light emitting diode D1 changes, which affects uniformity of the display. The present disclosure divides the driving time of the frame of the organic light emitting diode D1 into the driving times of N subframes. The data driving signal is divided into the active signal that drives display of the organic light emitting diode D1 and the blanking signal that turns off display of the organic light emitting diode D1 in the driving time of each of the subframes. The first semiconductor controllable switch T1 turns off and the energy-storage capacitor starts to discharge instead of charging in the time of outputting the blanking signal, which avoids the second semiconductor controllable switch from being influenced by long periods of the electric charge of the energy-storage capacitor C1, thereby improving uniformity of the display of the AMOLED.

Figure 3:
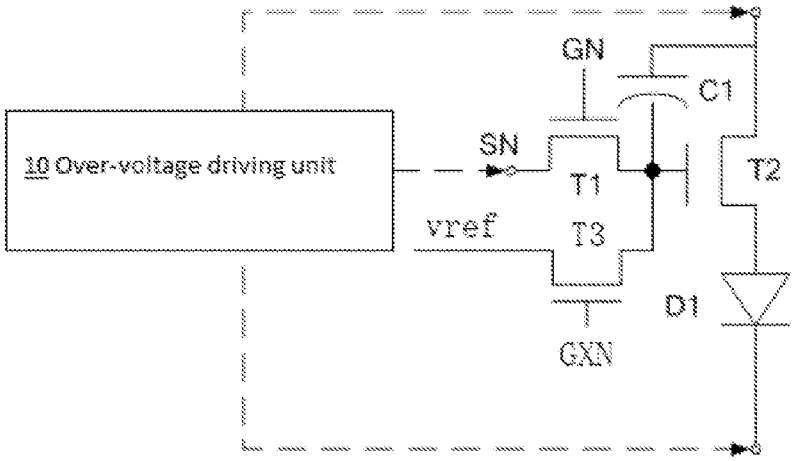
FIG. 3 is a schematic diagram of a driving circuit of an AMOLED having a third semiconductor switch of the present disclosure.

As shown in FIG. 3, in order to improve uniformity of the display of the AMOLED, the driving circuit uses a third semiconductor controllable switch T3, where the third semiconductor controllable switch T3 is connected in series with the gate electrode of the second semiconductor controllable switch T2, and a low level signal (logic 0) vref is input to the third semiconductor controllable switch T3.

The third semiconductor controllable switch T3 is used, which forcedly makes the electric charge of the energy-storage capacitor C1 be discharged, thereby effectively avoiding a deflection voltage of the first semiconductor controllable switch from being influenced by the electric charge of the energy-storage capacitor C1.

The present disclosure will further be described in detail in accordance with the figures and the exemplary examples.

Figure 4:
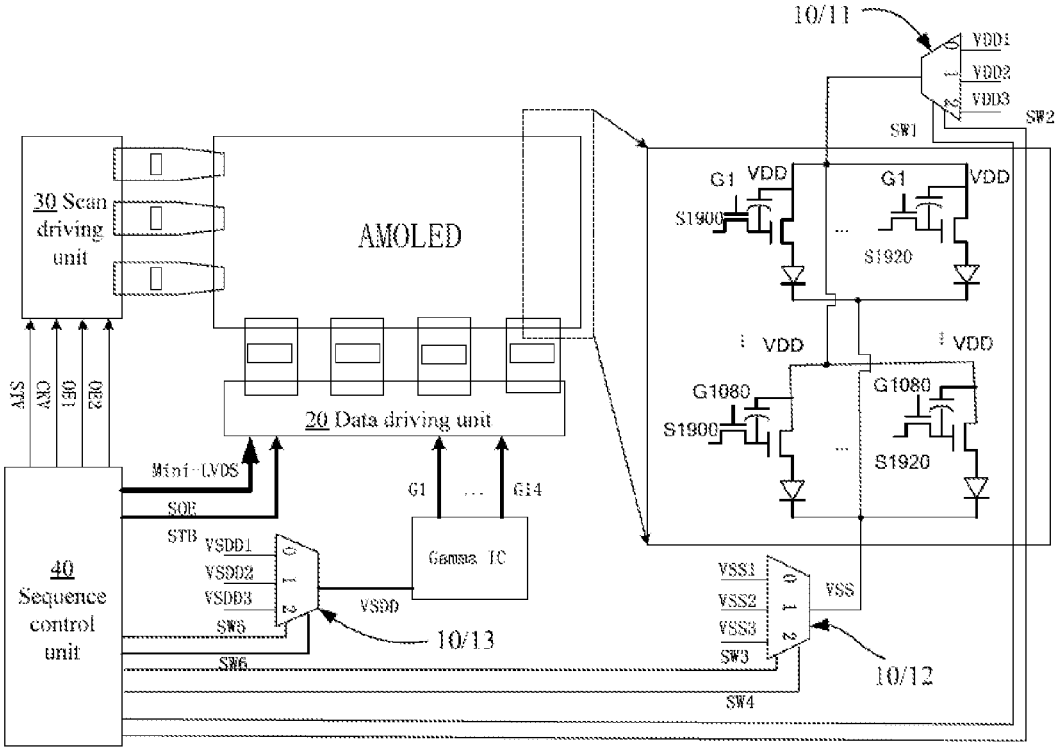
FIG. 4 is a schematic diagram of a driving circuit of an AMOLED of an example of the present disclosure.

As shown in FIG. 3 and FIG. 4, the driving circuit of the AMOLED of the example comprises the first semiconductor controllable switch T1, the second semiconductor controllable switch T2, the energy-storage capacitor C1, and the organic light emitting diode D1. The output end of the second semiconductor controllable switch T2 is coupled to the anode of the organic light emitting diode D1, the source electrode of the first semiconductor controllable switch T1 receives the data driving signal SN of the AMOLED, the gate electrode of the first semiconductor controllable switch T1 receives the scan driving signal GN of the AMOLED, a drain electrode of the first semiconductor controllable switch T1 is connected with the gate electrode of the second semiconductor controllable switch T2, and the energy-storage capacitor C1 is connected in series between the source electrode and the gate electrode of the second semiconductor controllable switch T2.

The driving circuit of the AMOLED further comprises a scan driving unit 30, a data driving unit 20 that provides the data driving signal, and a gamma correction unit (Gamma IC) coupled to the data driving unit, where the data driving unit 20 is connected with the source electrode (S1900-S1920) of the first semiconductor controllable switch corresponding to each of the organic light emitting diodes D1 through a data line. The scan driving unit 30 is connected with the gate electrodes (G1-G1080) of the first semiconductor controllable switch corresponding to each of the organic light emitting diodes D1 through a scan line.

The driving circuit of the AMOLED comprises the sequential control unit 40 that divides the driving time of one frame of the organic light emitting diode D1 into driving times of 8 subframes. The data driving signal is divided into the active signal that drives display of the organic light emitting diode D1 and the blanking signal that turns off display of the organic light emitting diode D1 in the driving time of each of the subframes. The driving time of each of the subframes comprises the time of outputting the active signal and the time of outputting the blanking signal. In the driving time of one frame of the organic light emitting diode D1, the time of outputting the active signal of the driving time of each of the subframes successively increases. Sequences of the scan driving unit and the data driving unit are provided by the sequential control unit.

An over-voltage driving unit 10 comprises a first multiplexer 11, a second multiplexer 12, and a third multiplexer 13. An input end of the first multiplexer 11 receives three reference voltages VDD1-VDD3 that are different, an output end of the first multiplexer 11 is coupled to an input end of the second semiconductor controllable switch T2, and the sequential control unit 40 outputs control signals (SW1, SW2) to a control end of the first multiplexer 11. An input end of the second multiplexer 12 receives three reference voltages VSS1-VSS3 that are different, an output end of the second multiplexer 12 is coupled to the cathode of the organic light emitting diode D1, and the sequential control unit 40 outputs control signals (SW3, SW4) to a control end of the second multiplexer 12. An input end of the third multiplexer 13 receives three reference voltages VSDD1-VSDD3 that are different, an output end of the third multiplexer 13 is coupled to the gamma correction unit, and the sequential control unit 40 outputs control signals (SW5, SW6) to a control end of the third multiplexer 13.

Figure 5:
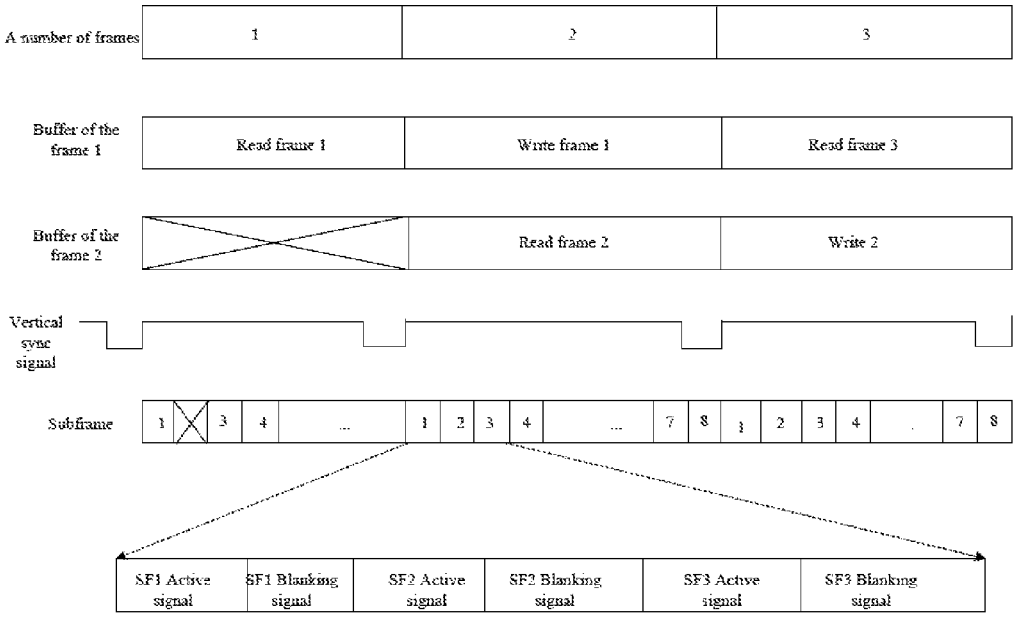
FIG. 5 is a sequential diagram of a driving method of an AMOLED of an example of the present disclosure.

As shown in FIG. 5 and table 1, in the driving times from a first subframe to a fifth subframe, the time of outputting the active signal successively increases in the driving time of each of the subframes. From the driving time of a sixth subframe, in a time of outputting the blanking signal of the driving time of each of the subframes, the first multiplexer 11 and the third multiplexer 13 both output one reference voltage, where the reference voltage successively increases. The second multiplexer 12 outputs one reference voltage, where the reference voltage successively reduces, and the time of outputting the active signal of the driving time of the each of the subframes is equal to the time of outputting the active signal of the driving time of the fifth subframe.

In the example, each of the multiplexers receives three reference voltages, where the three reference voltages are in a multiple relationship, and are two times, four times, eight times of a typical driving voltage.

Three multiplexers may not switch on at a same time, it should be considered that, one or two of the multiplexers can switch on.

TABLE 1

| | | SF1 | SF2 | SF3 | SF4 | SF5 | SF6 | SF7 | SF8 | Total brightness |
|---|---|---|---|---|---|---|---|---|---|---|
| AMOLED structure | Brightness | 1/8 | 1/8 | 1/8 | 1/8 | 1/8 | 1/8 | 1/8 | 1/8 | 1 |
| The AMOLED is driven through using the PWM Voltage is constant | Brightness | 1/8<br>1/256 | 1/8<br>2/256 | 1/8<br>4/256 | 1/8<br>8/256 | 1/8<br>16/256 | 1/8<br>32/256 | 1/8<br>64/256 | 1/8<br>128/256 | 1/8 |
| | Charging time (charging grey scale/full grey scale) | 1/256 | 2/256 | 4/256 | 8/256 | 16/256 | 32/256 | 64/256 | 128/256 | 1 |
| voltage is constant Firing time of keeping brightness | Brightness | 1/8<br>8/256 | 1/8<br>16/256 | 1/8<br>32/256 | 1/8<br>64/256 | 1/8<br>128/256 | 1/8<br>256/256 | 1/8<br>512/256 | 1/8<br>1024/256 | |
| | Charging time (charging grey scale/full grey scale) | 8/256 | 16/256 | 32/256 | 64/256 | 128/256 | 256/256 | 512/256 | 1024/256 | 1 |
| Voltage is adjusted Firing time of keeping brightness | Brightness | 1/8<br>8/256 | 1/8<br>16/256 | 1/8<br>32/256 | 1/8<br>64/256 | 1/8<br>128/256 | 1/8<br>128/256<br>2 times voltage | 1/8<br>128/256<br>4 times voltage | 1/8<br>128/256<br>8 times voltage | |
| | Charging time (charging grey scale/full grey scale) | 8/256 | 16/256 | 32/256 | 64/256 | 128/256 | 128/256 | 128/256 | 128/256 | |

When the voltage is constant, in order to compensate brightness of the organic light emitting diode D1, driving gray scales are required to reach at 256, 515, and 1024 in the driving time of last three subframes. But display gray scale at most is 256, thus, 512 and 1024 gray scales cannot be reach. When the multiplexers is used to adjust the voltage, the driving gray scales only needs to maintain 128 in the driving time of last three subframes, thereby compensating brightness of the organic light emitting diode D1.

The present disclosure uses a pulse-width modulation (PWM) to drive the AMOLED, and the driving time of one frame of the organic light emitting diode D1 is divided into driving times of 8 subframes to obtain effect of the different gray scales. Thus, in the driving time of the subframe, if the time of outputting the active signal is short, the time of outputting the blanking signal is correspondingly long, which cause greater for brightness loss. Therefore, when driving the subsequent subframes, transmission speed of the data driving signal needs to correspondingly increase to compensate brightness loss. However, the transmission speed of the data driving signal is limited by transmission speed of interface of the driving circuit, and as resolution of the display panel increases, limitation of the transmission speed of the data driving signal correspondingly increases. The present disclosure increases the driving voltage of the organic light emitting diode D1 in the time of outputting the blanking signal, thus, in the time of outputting a next active signal, the current of the organic light emitting diode D1 correspondingly increases because of increased driving voltage. The driving voltage stops increasing after the time of outputting the blanking signal, which does not occupy display time of the organic light emitting diode D1. Even if the transmission speed of interface of the driving circuit limits the transmission speed of the data driving signal, the driving voltage also can be increased in the time of outputting the blanking signal. In addition, in the time of outputting the blanking signal, the organic light emitting diode D1 does not display, change of the voltage cannot cause a display image to flicker.

A voltage of the anode of the organic light emitting diode D1 increases and a voltage of the cathode of the organic light emitting diode D1 decreases, which directly increase voltage difference between the anode and the cathode of the organic light emitting diode D1 to increase the current of the organic light emitting diode D1 and improve the brightness of the organic light emitting diode D1. The organic light emitting diode D1 is connected in series with the semiconductor controllable switch, where the semiconductor controllable switch works in the saturation region, and the data driving signal is coupled to the gate electrode of the semiconductor controllable switch. Thus, a voltage of the data driving signal increases and the current of the organic light emitting diode D1 correspondingly increases, which increases the brightness of the organic light emitting diode D1.

The present disclosure provides a method for driving the AMOLED comprises:

controlling the current of the organic light emitting diode D1 to increase in the driving time of one frame of the organic light emitting diode D1.

Figure 6:
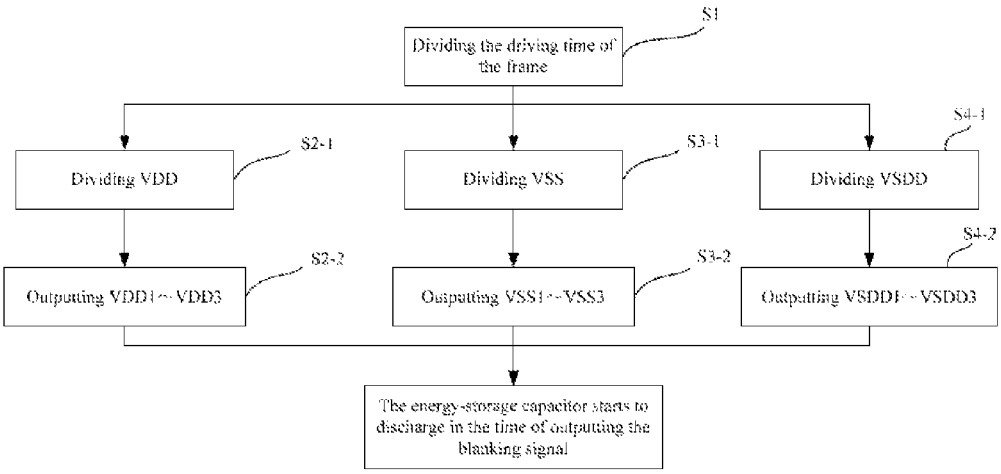
FIG. 6 is flowchart of a method for driving an AMOLED of an example of the present disclosure.

As shown in FIG. 6, the present disclosure will further be described in detail.

S1: dividing the driving time of one frame of the organic light emitting diode D1 into driving times of 8 subframes, and the data driving signal is divided into the active signal that drives display of the organic light emitting diode D1 and the blanking signal that turns off display of the organic light emitting diode D1 in the driving time of each of the sublimes. In the driving time of one frame of the organic light emitting diode D1, the time of outputting the active signal of the driving time of each of the subframes successively increases, and the driving time of each of the subframes is same.

When one frame is divides into the plurality of subframes, three methods are used to increase the current of the organic light emitting diode D1, where three methods can be used separately, and also can be combined to use.

A first method:

S2-1: dividing the voltage (VDD) input to the anode of the organic light emitting diode D1 into three levels reference voltage.

S2-2: from the driving time of the sixth subframe, outputting one reference voltage VDD1-VDD3 in the time of outputting the blanking signal of the driving time of each of the subframes, where the reference voltage successively increases.

A second method:

S3-1: dividing the voltage (VSS) input to the cathode of the organic light emitting diode D1 into three levels reference voltage.

S3-2: from the driving time of the sixth subframe outputting one reference voltage VSS1-VSS3 in the time of outputting the blanking signal of the driving time of each of the subframes, where the reference voltage successively reduces.

A third method:

S4-1: dividing an increment voltage (VSDD) of the data driving signal of the organic light emitting diode D1 into three levels increment voltage.

S4-2: from the driving time of the sixth subframe on, outputting one increment voltage VSDD1-VSDD3 in the time of outputting the blanking signal of the driving time of each of the subframes where the increment voltage successively increases.

S5: discharging the energy-storage capacitor that corresponds to the organic light emitting diode in the time of outputting any one or more blanking signals.

The present disclosure also may discharge the energy-storage capacitor in the driving time of one frame of the organic light emitting diode, thereby effectively avoiding the deflection voltage of the first semiconductor controllable switch from being influenced by the electric charge of the energy-storage capacitor, and improving uniformity of the display of the AMOLED.

The driving time of each of the subframes also may be different, and a number of the subframes is not limited to 8. A number of the subframes is more, and effect of brightness of corresponding gray scale is better and control costs are also correspondingly increase. Thus, the present disclosure chooses a number of the subframes is in a range of 2-10. The voltage input to the anode of the organic light emitting diode D1, the voltage input to the cathode of the organic light emitting diode D1, and the increment voltage of the data driving signal of the organic light emitting diode D1 are not limited to three levels, which also can increase or reduce according to requirement.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure the technical personnel can also make simple deductions or replacements, and all of which should be considered to belong to the protection scope of the present disclosure.

We claim:

1. A driving circuit of an active matrix/organic light emitting diode (AMOLED) display, comprising:

a first semiconductor controllable switch;

a second semiconductor controllable switch;

an energy-storage capacitor;

an organic light emitting diode;

a sequential control unit that divides a driving time of one frame of the organic light emitting diode into driving times of N subframes; and an over-voltage driving unit that increases current of the organic light emitting diode when the organic light emitting diode displays; the over-voltage driving unit comprises a data driving unit that provides the data driving signal and a gamma correction unit coupled to the data driving unit;

wherein an output end of the second semiconductor controllable switch is coupled to an anode of the organic light emitting diode, a source electrode of the first semiconductor controllable switch receives a data driving signal of the AMOLED, a gate electrode of the first semiconductor controllable switch receives a scan driving signal of the organic light emitting diode, a drain electrode of the first semiconductor controllable switch is connected with a gate electrode of the second semiconductor controllable switch, and the energy-storage capacitor is connected in series between a source electrode and the gate electrode of the second semiconductor controllable switch;

wherein the data driving signal is divided into an active signal that chives display of the organic light emitting diode, and a blanking signal that turns off display of the organic light emitting diode in tire driving time of each of the subframes;

wherein N is a natural number and is greater than or equal to 2;

in a time of outputting any one or more blanking signals, the over-voltage driving unit increases current of the organic light emitting diode through increasing a voltage of an output end of the second semiconductor controllable switch, reducing a voltage of the cathode of the organic light emitting diode, and increasing an output voltage of the gamma correction unit.

2. The driving circuit of the organic light emitting diode display of claim 1, further comprising a third semiconductor controllable switch, the third semiconductor controllable switch is connected in series with the gate electrode of the second semiconductor controllable switch, and a low level signal is input to the third semiconductor controllable switch.

3. The driving circuit of the organic light emitting diode display of claim 1, wherein the over-voltage driving unit comprises a first multiplexer, a second multiplexer, and a third multiplexer; an input end of the first multiplexer receives X reference voltages that are different, an output end of the first multiplexer is coupled to an input end of the second semiconductor controllable switch, and the sequential control unit is coupled to a control end of the first multiplexer;

in the driving time from a first subframe to a (N−X)th subframe, a time of outputting the active signal of the driving time of each of the subframes successively increases; from the driving time of a (N−X+1)th subframe on, the first multiplexer outputs one reference voltage in the time of outputting the blanking signal of the driving time of each of the subframes, and the reference voltage successively increases; the time of outputting the active signal of the driving time of the each of the subframes is equal to the time of outputting the active signal of the driving time of a (N−X)th subframe;

wherein an input end of the second multiplexer receives Y reference voltages that are different, an output end of the second multiplexer is coupled to a cathode of the organic light emitting diode, and the sequential control unit is coupled to a control end of the second multiplexer; from the driving time of a (N−Y)th subframe on, the second multiplexer outputs one reference voltage in the time of outputting the blanking signal of the driving time of each of the subframes, and the reference voltage successively reduces;

wherein an input end of the third multiplexer receives Z reference voltages that are different, an output end of the third multiplexer is coupled to the gamma correction unit, and the sequential control unit is coupled to a control end of the third multiplexer; from the driving time of a (N−Z)th subframe on, the third multiplexer outputs one reference voltage in the time of outputting the blanking signal of the driving time of each of the subframes, and the reference voltage successively increases;

wherein X, Y, and Z are natural numbers, and are less than N.

* * * * *